United States Patent [19]

Maes

[11] Patent Number: 4,938,153

[45] Date of Patent: Jul. 3, 1990

[54] PORTABLE ADJUSTABLE TABLE

[76] Inventor: Daniel T. Maes, 207 Francis St., Kaukauna, Wis. 54130

[21] Appl. No.: 322,614

[22] Filed: Mar. 13, 1989

[51] Int. Cl.[5] ..... A47B 3/00

[52] U.S. Cl. ..... 108/128; 108/6

[58] Field of Search ..... 108/4, 6, 9, 10, 115, 108/116, 129, 128, 134, 135, 144

[56] References Cited

U.S. PATENT DOCUMENTS

| | | | |
|---|---|---|---|
| 2,199,895 | 5/1940 | Sharp | 108/4 |
| 2,260,732 | 10/1941 | Anderson et al. | 108/4 |
| 2,563,060 | 8/1951 | O'Neill | 108/6 X |
| 3,240,170 | 3/1966 | Shave | 108/115 X |
| 3,894,709 | 7/1975 | Weir | 108/49 X |
| 3,903,812 | 9/1975 | Cowley | 108/4 X |
| 3,908,560 | 9/1975 | Horner | 108/6 X |
| 4,058,066 | 11/1977 | Altman | 108/10 X |
| 4,383,486 | 5/1983 | Reineman | 108/6 X |

*Primary Examiner*—Peter A. Aschenbrenner

*Attorney, Agent, or Firm*—Andrus, Sceales, Starke & Sawall

[57] ABSTRACT

A portable adjustable table assembly is made of a lightweight tubular construction and provides an extremely wide range of adjustable positions to accommodate persons seated, confined to bed, or standing. The assembly includes a flat U-shaped base, a pair of extensible, telescoping legs extending vertically upward from one end of the base, and a dual axis table assembly including a pair of support arms pivotally attached to the upper ends of the legs and a pair of table arms pivotally attached to the support arms. The table arms may be pivoted between an extended position outwardly of the support arms and a retracted position within the support arms, both of which positions can be utilized to support a table top in a horizontal position. Either or both of the pivotal connections may be provided with bi-directional ratchet assemblies to provide a wide range of angular positions for the table top between the two primary horizontal positions. The entire assembly can folded into a compact stack for ease of storage or transport.

18 Claims, 2 Drawing Sheets

PORTABLE ADJUSTABLE TABLE

BACKGROUND OF THE INVENTION

The present invention pertains to a multifunction portable adjustable table and, in particular, to an easily adjustable table adaptable to many uses in the home and elsewhere and which can be readily folded for transport or storage.

It is often convenient or necessary to provide a table for use by a person who is confined to bed or someone who is seated or standing in a position or in a manner such that access to and use of a conventional table is inconvenient or impossible. For example, specially constructed tables for use by persons confined to bed are well known. Such tables typically include a base which can be slid under the bed, a vertical support extending up from one end of the base, and a table attached to the upper end of the vertical support and adapted to extend over the bed. The table is typically adjustable vertically and may also be pivotable with respect to the base and the vertical support about a vertical axis. So-called "TV tables" of various sizes, shapes, and constructions are also well known for convenient portable use by persons seated on furniture which is either too low or not readily disposed for access to a conventional table. Also, tables having a higher working surface than a conventional table for use while standing are also well known. These may include, for example, portable work tables and podiums.

However, tables used in each of the foregoing general classes, though possibly adjustable and portable to some extent, are usually confined to a particular type of use. In other words, tables useful for someone confined to a bed are usually not suitable for use as TV tables, nor are work tables or podiums intended for use primarily when standing. Obviously, the opposite is true for TV-type tables which are of generally limited utility.

U.S. Pat. No. 3,604,734 shows a portable adjustable table assembly capable of being used in each of the three broad classes of use described above. However, that table is constructed generally in the manner of that class of tables used for persons confined to bed. Thus, it includes a base supported on wheels, a vertical support attached to one end of the base and a table top attached to the upper end of the support and adjustable vertically and horizontally with respect to the support and the base. The assembly is also adapted to be folded so that each of the members is disposed in a common plane to facilitate storage.

SUMMARY OF THE INVENTION

In accordance with the present invention, there is provided a portable adjustable table assembly which provides broad utility for persons seated, standing, or confined to bed. Further, the wide adjustability of the table assembly of the present invention provides precise adjustability in any of the broad types of use to which it is adaptable. The table may be made of lightweight materials and folded to a substantially flat configuration for ease of transport or storage.

All of the main members of the table assembly are preferably of a tubular construction. The assembly includes a supporting base preferably comprising a Ushaped frame member. A pair of parallel vertically disposed lower legs are attached to the ends of the Ushaped base frame member, and a pair of parallel upper legs is attached to the lower legs for vertical axial adjustable movement with respect thereto. A pair of parallel support arms is pivotally connected to the upper ends of the upper legs to provide relative rotation between the support arms and the upper legs about a first horizontal axis. First stop means operatively interconnecting the support arms and the upper legs limit the relative rotation about the first horizontal axis in at least one direction. A pair of parallel table arms is disposed with one end of each of the arms pivotally connected to one of the other ends of each of the support arms to provide relative rotation between the table arms and the support arms about a second horizontal axis parallel to the first axis. Second stop means interconnects the table and support arms to limit the relative rotation between them in both directions. A table top is attached to the table arms and disposed generally in a plane parallel to the plane defined by the table arms.

Separate and functionally varying embodiments of both the first and second stop means are provided. Each embodiment of one stop means may be used exclusively or the stop means embodiments may be utilized together to provide redundancy of support and wider adjustability. In its most basic construction, the first stop means includes abutment surfaces on the pivotally connected ends of the upper legs and the support arms which abutments are disposed to limit rotation of the support arms to a generally horizontal position directly above the supporting base, but to permit virtually unrestricted rotation of the support arms in the opposite direction to a stored position. Alternately, the first stop means comprises a rotating ratchet assembly integrally attached to the pivotal connection between the support arms and the upper legs. Preferably, the ratchet assembly includes a separate ratchet for each pivotal connection between a support arm and an upper leg and the ratchets are preferably bi-directional in operation. Common control means may be utilized to interconnect the ratchet assemblies to effect simultaneous control of their operation.

In its most basic construction, the second stop means comprises a pair of first stop plates which provide engagement between the table arms and the support arms in response to rotation of the table arms in one direction to an extended table position generally co-planar with the support arms when the latter are disposed in their generally horizontal position. The second stop means also includes a pair of second stop plates adapted to provide engagement between the table arms and the support arms in response to rotation of the table arms in the other direction to a retracted table position between the support arms and co-planar therewith when the support arms are disposed in their generally horizontal position. Both the first and second stop plates may be conveniently attached to one or the other of the table arms or support arms and disposed to engage the surfaces of the other of said arms. In its alternate embodiment, the second stop means comprises a bi-directional rotatable ratchet assembly formed as an integral part of the pivotal connections between the table arms and the support arms. The rotatable ratchet assembly may be essentially identical to the alternate embodiment of the first stop means and include a ratchet for each pivotal connection and a common control means interconnecting the two ratchets for effecting simultaneous control of their operation.

The table top is demountably attachable to the table arms and includes fasteneing means which are disposed to allow the table top to be attached to either side of the table arms to place the working surface of the table top in an accessible position when the table arms are in either their extended or retracted position. Further, utilization of the embodiment of the stop means including the ratchet assemblies allows universal pivotal movement of the table top through a wide arc between its two basic extended and retracted positions. When combined with the use of ratchet assemblies for the first top means, an even greater range of table top adjustment positions is provided.

The U-shaped base frame is also pivotally attached to the lower legs to rotate about a third horizontal axis parallel to the first and second axes. In this manner the pairs of support arms, table arms, and base frame arms are all rotatable about their respective axes to a stored position in a stacked, parallel and closely spaced arrangement.

DETAILED DESCRIPTION OF THE PREFERRED EMBODIMENTS

Figure 1:
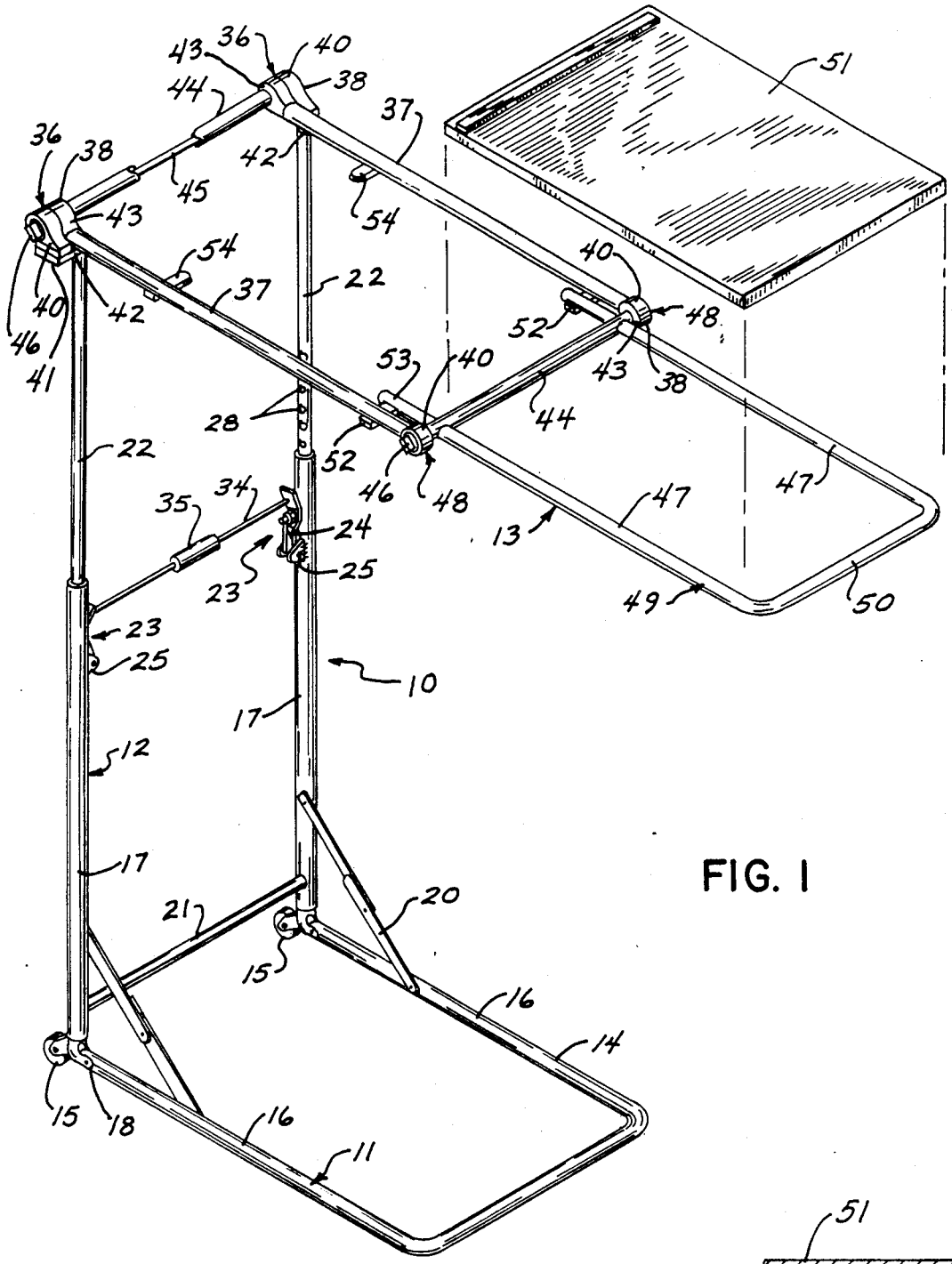
FIG. 1 is a perspective view of the portable table assembly of the present invention showing the table and table arms disposed in their horizontal extended position.

Referring particularly to FIGS. I and 2, the portable table assembly 10 includes a lower supporting base 11, a vertically disposed extensible leg assembly 12 and an adjustable table supporting assembly 13. The support base 11 comprises a generally U-shaped frame member 14 made of a tubular lightweight metal construction, such as aluminum. The frame member 14 is adapted to lie directly on the floor or other supporting surface, but may optionally be provided with a pair of wheels or casters 15 to assist in movement. The free ends of the legs 16 of the U-shaped frame member 14 are attached to the lower ends of a pair of lower legs 17 of the leg assembly 12. A hinged joint 18 is provided at the connections between the base frame legs 16 and the lower legs 17 to provide rotation of the support base 11 with respect to the leg assembly 12 between the supporting position shown in FIGS. 1 and 2 and the stored position shown in FIG. 5. A collapsible folding brace 20 of a conventional well known construction interconnects each of the base legs 16 and a lower leg 17 at points spaced from the hinged joint 18 to maintain the base frame member 14 in the supporting position, but to be collapsed and folded with rotation of the base frame member 14 to its stored position. The wheels 15 are preferably attached to the backside of the hinged joint 18 which is axially aligned with the lower leg 17. In this manner, the wheels provide added stability against any tendency for the table assembly to be tipped backwards.

The lower legs 17 are parallel and extend vertically upwardly from the support base 11. A cross member 21 is rigidly attached to the lower ends of the lower legs 17 to provide rigidity to the structure. The lower legs 17 are also of a tubular construction and each is adapted to receive in a coaxial telescoping relation the lower end of a tubular upper leg 22. The upper legs 22 preferably have an outer diameter just slightly smaller than the inner diameter of the tubular lower legs 17, such that the upper legs will telescope into and slide easily within the lower legs to provide the principle vertical height adjustment for the table assembly 10.

Figure 4:
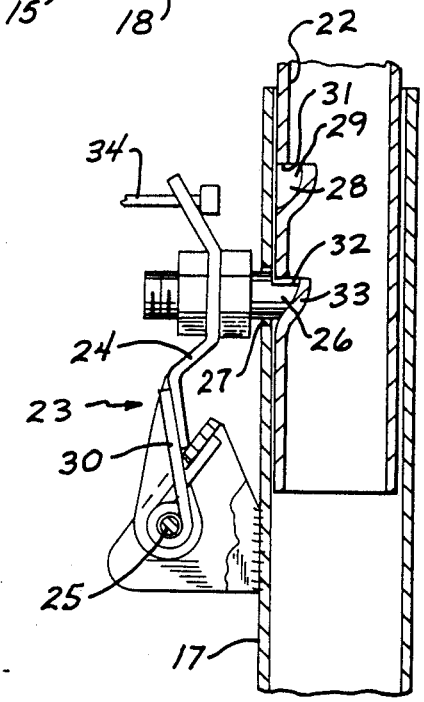
FIG. 4 is an enlarged vertical section through the adjustable attachment between the lower and upper legs of the assembly.

Referring also to FIG. 4, relative vertical positioning between the lower and upper legs 17 and 22, respectively, is provided by a ratcheting lock mechanism 23 operatively interconnecting each telescoped pair of legs 17 and 22. Many types of adjustable locking mechanisms may be utilized and FIG. 4 shows the presently preferred embodiment of such a mechanism. The lock mechanism 23 includes a latch bar 24 pivotally attached with a pivot pin 25 to the outside of each lower leg 17 near the upper end thereof. A locking detent 26 is attached to the upper end of the latch bar 24 and is disposed to extend radially into the leg through a hole 27. Each of the upper legs 22 is provided with a series of adjustment notches 28 which are disposed to be serially aligned with the access hole 27 in the lower leg as the upper leg is moved vertically in telescoping relation with respect to the lower leg. A torsion spring 30 is mounted about the pivot pin 25 and attached in a manner to bias the upper end of the latch arm 24 against the lower leg 17 to maintain the detent 26 in engagement with an adjustment notch 28 via the access hole 27. The adjustment notches 28 each preferably has a flat upper surface 31 provided by making a horizontal slit in the leg 22 and pressing the surface of the leg just below the slit inwardly to form a depression 29. The flat upper surface 31 of the notch 28 is adapted to be engaged by a locking flat 32 on the upper edge of the detent 26. The lower portion of the detent 26 has a rounded face 33 which engages and rides over the surface of the depression 29 providing a ratcheting effect as the upper legs 22 are pulled upwardly out of the lower legs 17 to raise the height of the assembly. As it well known in the art, the bias of torsion spring 30 will cause the detent 26 to engage each adjustment notch 28 and to retain a selected position by engagement between the locking flat 32 and the flat upper edge 31 of an adjustment notch 28. Simultaneous operation of the locking mechanisms 23 on each of the lower legs 17 may be provided by an operating cord 34 interconnecting the upper ends of the latch bars 24. By either pulling upwardly or pushing downwardly on the cord 34, the attached latch bars 24 will pivot about pins 25 to cause the detent 26 to be withdrawn from the adjustment notch 28. The operating cord 34 may conveniently include a centrally disposed operating handle 35.

The table supporting subassembly 13 is pivotally attached to the upper ends of the upper legs 22 by a pair of first pivotal connections 36. A pair of parallel support arms 37 is disposed with one end of each support arm 37 connected by a pivotal connection 36 to an upper leg 22 such that the support arms may be rotated together with respect to the leg assembly 12 about a horizontal axis which is parallel to the planes defined by each of the pairs of support arms 37 and upper legs 22.

Although the first pivotal connections 36 may comprise any kind of conventional hinged joint, in the preferred embodiment, each of the pivotal connections 36 comprises a ratchet assembly 38 which may be constructed and operate in the same manner as a conventional bi-directional ratchet handle used on hand tools. Thus, the ratchet assembly 38 includes an outer housing 40 attached to the upper end of each upper leg 22. The ratchet housing 40 is mounted to be offset both outwardly and rearwardly of the vertical axis of the upper leg. To provide the offset mounting, the interconnection between the ratchet housing 40 and the top of the upper leg 22 is provided by an intermediate mounting block 41 having a generally L-shaped configuration. The ratchet housing 40 is attached to one leg of the mounting block 41 and the other leg of the mounting block lies over and is attached to the upper end of the upper leg 22 to provide an abutment pad 42.

For each of the ratchet assemblies 38 comprising the first pivotal connections, the interior portion 43 of the assembly 38 which is rotatable within the housing 40 is attached to one end of a support arm 37. To provide for uniform rotation of the support arms about their pivotal connections 36, a connecting tube 44 extends between and is rigidly attached to the interior portions 43 of the ratchet assemblies. In addition, to provide for common control of the ratchet mechanism, a control rod 45 is disposed within the connecting tube 44 and interconnects the ratchet control mechanisms operable from either side by the ratchet control lever 46. This arrangement avoids both the inconvenience of having to separately operate the control levers 46 and also assures that uniform rotation of the support arms 37 occurs such that one or the other is not displaced from their parallel, coplanar relationship.

It will be readily appreciated that the interconnected ratchet assemblies 38 allow the support arms 37 to be rotated about the vertically disposed leg assembly 12. However, because the preferred operative position of the support arms is the horizontally disposed position shown in FIGS. 1 and 2, the offset mounting of the ratchet housings 40 (via the mounting blocks 41) causes the interior portions 43 at the points of connection to the support arms 37 to engage the abutment pads 42 as the support arm assembly is rotated to the operative horizontal position. Obviously, the adjustable locking ability of the ratchet assemblies could also be utilized to establish and hold the support arms in the horizontal operating position, but the engagement between the support arms 37 and abutment pads 42 provides a supplemental stop which limits rotation of the support arms in a downward direction and provides positive support for the table assembly.

A pair of tubular table arms 47 are disposed in parallel co-planar relation and each is pivotally attached at one end to the other end of a support arm 37 via a second pivotal connection 48. Each of the second pivotal connections 48 may comprise a simple hinged joint sufficient to allow relative rotation between the table arms 47 and the support arms 37 about an axis parallel to the axis of the first pivotal connections 36. The opposite ends of the table arms 47 are connected by a cross arm 50 and, preferably, the table arms and cross arm comprise an integral U-shaped table support member 49 to provide enhanced strength and rigidity. The table arms 47 are spaced to fit within the support arms 37 in a manner such that, if unrestricted, the table arms could rotate in either direction through a full 360° circle with respect to the support arms.

However, to provide the most basic control and positioning of the table assembly, relative rotation between the table arms and support arms in both directions is limited to establish an extended table position with the table arms 47 rotated outside of the support arms 37, but disposed generally in the same plane (FIG. 1), and a retracted table position with the table arms rotated through an arc of 180° from the FIG. 1 position to a position between the support arms and co-planar therewith. A table top 51 is demountably attachable to the table arms on either side thereof, depending on whether the arms are in the extended or retracted position. In either position, of course, to be used as a conventional table surface, the support arms are normally disposed in a horizontal plane, as shown. To hold the table arms and attached table top 51 in the extended position, a pair of first stop plates 52 is attached to the extended end portion 53 of each table arm 47 such that the free ends of the stop plates 52 engage the underside of the adjacent ends of the support arms 37 to establish and hold the table arms in the extended position. Similarly, a pair of second stop plates 54 are attached to the undersides of the support arms 37 near the points of their first pivotal connections 36 to engage the underside of the table arms 47 as the same are rotated from the extended position shown to the retracted position between the support arms. The attachment and engagement ends of both the pair of stop plates 52 and 54 may obviously be reversed to effect the described relative positioning. The demountable table top 51 is, of course, moved from one side of the table arms to the other as the table assembly position is changed from the extended to the retracted position.

It is preferable, however, to provide the second pivotal connections 48 with interconnected, commonly-operable ratchet assemblies 38 which are identical to those used to provide the first pivotal connections between the support arms in 37 and the upper legs 22. Thus, a ratchet housing 40 is attached to the outer end of each support arm 37 and the relatively rotatable interior portion 43 of the ratchet assembly is attached to the adjacent end of each table arm 47. Also, the interior portions 43 of the ratchet assemblies 38 are rigidly interconnected with a connecting tube 44 to house a control rod 45 to effect common control of the ratchets through the operation of one control lever 46, in the same manner previously described with respect to the first pivotal connections 36. By incorporating ratchet assemblies for the second pivotal connections 48, virtually infinite adjustment of the position of the table arms and attached table top with respect to the support arms 37 may be provided between the extended and retracted positions. In addition, as in the case of the first pivotal connections 36 between the support arms and the upper legs, the ratchet assemblies 38 comprising the second pivotal connections 48 may be utilized to provide the sole means of positioning and limiting the movement of the table arms and attached table top. Thus, it is possible to eliminate completely the use of the first and second pairs of stop plates 52 and 54, respectively, and instead utilize the inherent holding capability of the ratchets to provide the desired positioning and holding. It is preferred, however, to utilize the stop plates for the primary means of limiting rotation between the table arms and support arms and establishing the extended and retracted positions of the former.

Figure 2:
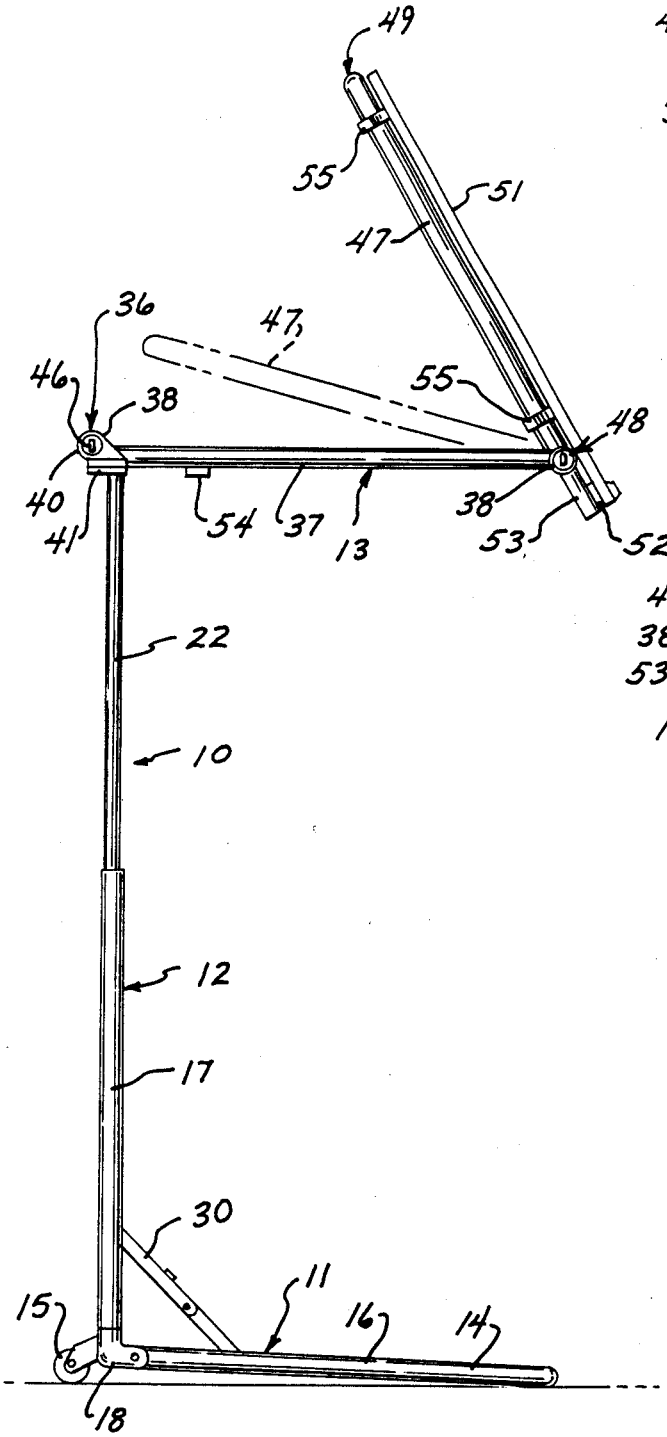
FIG. 2 is a side elevation view of the assembly shown in FIG. 1 with the table top attached to the opposite sides the table arms and the attached assembly rotated the retracted table position.

The abutment pads 42 establish and hold the support arms 37 in their primary holding position and, similarly, the stop plates 52 and 54 hold the table arms in their horizontal extended and retracted positions with respect to the horizontally deposed support arms. These are primary positions when the table assembly 10 is used as a table where the table top 51 is required to be essentially horizontally disposed. However, the wide adjustability provided by the ratchet assemblies of both the first and second pivotal connections 36 and 48, respectively, provide the ability to establish a wide range of table top positions between the primary extended and retracted positions. Referring particularly to FIG. 2, with the table top 51 attached to the surface of the table arms defining the retracted position, the ratchet assembly 38 of the second pivotal connections 48 can be utilized to selectively position the table top in an angular plane with respect to the horizontal. In this manner, the assembly may be utiized as a podium, easel, writing stand, or the like. Furthermore, by varying the length of the leg assembly 12 through operation of the lock mechanism 23, the vertical position or height of the table top 51 may also be varied through a wide range. Simultaneously, further vertical, horizontal, and angular positioning of the table top 51 may be provided by rotating the support arms 37 about the first pivotal connections 36 and locking them in a selected non-horizontal position by appropriate control of the ratchet assemblies 38. With the support arms 37 rotated to and held in a non-horizontal position, the table arms 47 and attached table top 51 may be positioned horizontally to provide for example, a higher table position than can be provided by vertical adjustment of the legs alone; or, the table top may be positioned at an angle to the horizontal to provide, for example, an extended height podium.

Figure 3:
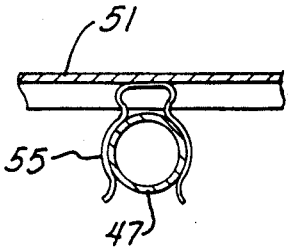
FIG. 3 is an enlarged partial section taken on line 3—3 of FIG. 2 showing details of the demountable fastener for attaching the table top to the table arms.

Referring to FIG. 3, the demountable attachment of the table 1 top 51 to the table arms 47 may be conveniently provided by one or more conventional spring clips 55 for each of the table arms 47. The clips 55 are mounted to the underside of the table top and depend downwardly to snap over the tubular table arm 47 in a well known manner. Various other types of demountable fasteners, such as snap fasteners, could also be used to attach the table top to the arms.

Figure 5:
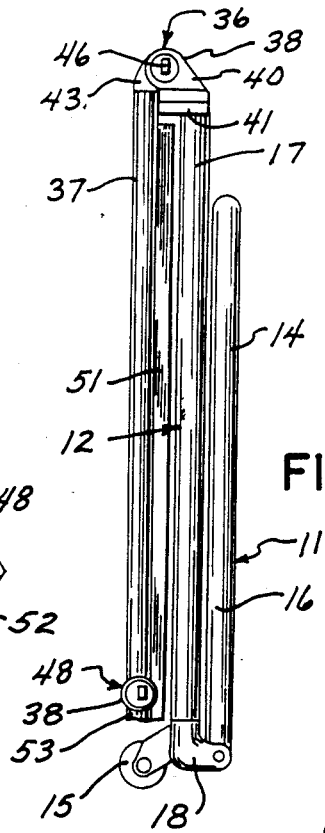
FIG. 5 is a partial side elevation of the FIG. 2 assembly in a fully folded position.

The entire table assembly 10 is adapted to be easily folded into a substantially flat stacked arrangement for storage or transport. When it is desired to collapse and fold the table assembly 10 from, for example, the position shown in FIG. 1 to the FIG. 5 position, the operating cord 34 is pulled (or pushed) to pivot the latch bars 24 and release the locking detents 26, thereby allowing the upper legs 22 to telescope downwardly into the lower legs 17. The control lever 46 of the ratchet assemblies 38 for the second pivotal connections 48 is appropriately positioned and the table arm assembly 49 is rotated through an arc of approximately 180° to the retracted position within the support arms 37 (and into engagement with the second stop plates 54, if utilized). The ratchet assemblies 38 for the first pivotal connections 36 are then unlocked (utilizing the common control provided by the control rod 45) and the support arm/table arm assembly is rotated upwardly and rearwardly through an arc of approximately 270° to the backside of the telescoped legs 16 and 22. The hinged braces 20 interconnecting the legs 16 of the support frame 14 and the lower legs 17 are collapsed and the support base is pivoted upwardly about the hinged joints 18 against the legs 17. Thus, as shown in FIG. 5, the entire assembly may be conveniently folded into a substantially flat stack of components disposed in a generally parallel arrangement. Depending on the thickness of the table top 51 and the offsets provided by the first and second pivotal connections 36 and 48, the table top may be left attached to the table arms as the assembly is folded.

It will be apparent from the foregoing description that the portable adjustable table assembly 10 of the present invention is widely adaptable through a substantial range of vertical, horizontal, and angular positions to accommodate various uses by persons seated, confined to bed, or standing to perform a wide variety of activities requiring a table-type surface. The assembly is lightweight, easy to move and adjust, and can be readily folded for storage or transport. Depending on the complexity and range of adjustability required or desired, various combinations of ratchet assemblies and stop plates may be utilized. The extended position of the table top provides the long reach often needed to properly accommodate a person confined to bed or to reach a person seated on furniture that is relatively deep. The retracted position likewise provides wide adaptability to accommodate persons seated, confined to bed, or standing. In addition, the variable angular positions to which the table top may be set utilizing either or both of the ratchet assemblies provides even greater versatility.

Various modes of carrying out the present invention are contemplated as being within the scope of the following claims particularly pointing out and distinctly claiming the subject matter which is regarded as the invention.

I claim:

1. A portable adjustable table assembly comprising:

a supporting base;

extensible leg means including a pair of parallel vertically disposed lower legs having lower ends attached to the lower legs for vertical axial movement with respect thereto;

a pair of parallel support arms having first pivotal connecting means for providing a pivotal connection between one end of each of said support arms and one upper end of each of said upper legs to allow relative rotation between said support arms and said upper legs about a first horizontal axis parallel to the planes defined by each of said pairs of upper legs and support arms;

first stop means for limiting the relative rotation in one direction between said support arms and said upper legs, including a first stop position with said support arms extending over the supporting base;

a pair of parallel table arms having second pivotal connecting means for providing a second pivotal connection between one end of each of said table arms and one of the other ends of each of said support arms to allow relative rotation between said table arms and said support arms about a second axis parallel to said first axis;

second stop means for limiting the relative rotation in both directions between said table arms and said support arms, including an extended table arm position with said table arms extending away from the plane of said upper legs, and a retracted table arm position with said table arms extending toward the plane of said upper legs; and, table top means attached to said table arms and disposed generally in a plane parallel to the plane defined by said table arms for presenting an upwardly facing table surface in said extended and retracted table arm positions.

2. The adjustable table assembly as set forth in claim 1 wherein the supporting base comprises a U-shaped frame member attached at its free ends to the lower legs and disposed generally perpendicular thereto in a suporting position.

3. The assembly as set forth in claim 2 wherein said base frame member is pivotally attached to said lower legs for rotation about a third axis parallel to said first and second axes between supporting and stored positions.

4. The assembly as set forth in claim 3 including collapsible brace means interconnecting said base frame member and one of said lower legs for maintaining said base frame in its supporting position.

5. The assembly as set forth in claim 4 wherein said collapsible brace means is adapted to collapse with rotation of said base frame to its stored position.

6. The table assembly as set forth in claim 1 wherein said lower and upper legs are tubular and disposed in coaxial telescoping relation to one another.

7. The assembly as set forth in claim 6 wherein said upper legs are disposed to move within said lower legs.

8. The assembly as set forth in claim 6 including manually operable positioning means interconnecting said upper and lower legs for varying the length of said extensible leg means.

9. The table assembly as set forth in claim 1 wherein said first stop means comprises first abutment surfaces on the pivotally connected ends of said upper legs and said support arms, said first abutment surfaces disposed to establish said first stop position with the support arms in a generally horizontal position directly above the supporting base.

10. The assembly as set forth in claim 9 wherein said first stop means are disposed to permit rotation of said support arms in the opposite direction.

11. The assembly as set forth in claim 10 wherein said support arms are rotatable in said opposite direction to a stored position with the plane of the support arms generally parallel to the plane of the leg means.

12. The assembly as set forth in claim 9 wherein said second stop means comprises first stop plates providing engagement between said table arms and said support arms in response to rotation of said table arms in one direction to said extended table arm position such that said table arms are generally co-planar with the support arms.

13. The assembly as set forth in claim 12 wherein said second stop means further comprises second stop plates providing engagement between said table arms and said support arms in response to rotation of said table arms in the other direction to said retracted table arm position such that said table arms are disposed between the support arms and co-planar therewith.

14. The assembly as set forth in claim 13 wherein said first and second stop plates are attached to one of said table arms and support arms and disposed to engage the surfaces of the other of said table arms and support arms.

15. The table assembly as set forth in claim 1 wherein said table top means comprises a removable table top and further including means for demountably fastening said table top to said table arms.

16. The assembly as set forth in claim 15 wherein said fastening means are disposed to allow said table top to be attached to either side of said table arms.

17. The assembly as set forth in claim 16 including a cross arm interconnecting the ends of the table arms opposite their second pivotal connections to provide a rigid U-shaped table support.

18. The assembly as set forth in claim 3 wherein said pairs of support arms, table arms, and base frame arms are rotatable about their respective first, second and third axes to a stored position in which the planes defined by each said pair are substantially parallel and closely spaced.

* * * * *